United States Patent [19]

Sukolics

[11] 4,283,895

[45] Aug. 18, 1981

[54] THERMALLY IMPROVED EXPANDED STORE FRONT SYSTEM

[75] Inventor: Ronald D. Sukolics, Creve Coeur, Mo.

[73] Assignee: Swiss Aluminium Ltd., Chippis, Switzerland

[21] Appl. No.: 91,256

[22] Filed: Nov. 5, 1979

Related U.S. Application Data

[63] Continuation of Ser. No. 951,921, Oct. 16, 1978, Pat. No. 4,214,415.

[51] Int. Cl.[3] ..... E04B 1/62; E04B 2/88

[52] U.S. Cl. ..... 52/395; 52/775; 49/DIG. 1

[58] Field of Search ..... 52/395, 770, 775; 403/406, 408, 381; 85/80, 7; 151/21 R; 49/DIG. 1

[56] References Cited

U.S. PATENT DOCUMENTS

| | | | |
|---|---|---|---|
| 2,391,513 | 12/1945 | Randall | 151/21 R |
| 2,901,785 | 1/1959 | Hinchliffe et al. | 52/395 |
| 3,110,337 | 11/1963 | Biesecker | 85/80 |
| 3,404,596 | 10/1968 | Ryder | 85/82 |
| 3,719,014 | 3/1973 | Sukolics | 52/775 |
| 4,055,923 | 11/1977 | Biebuyck | 52/397 |
| 4,214,415 | 7/1980 | Sukolics | 52/395 |

FOREIGN PATENT DOCUMENTS

| | | | |
|---|---|---|---|
| 1300846 | 7/1962 | France | 52/395 |
| 961136 | 6/1964 | United Kingdom | 52/501 |
| 1109793 | 4/1968 | United Kingdom | 85/80 |

*Primary Examiner*—James L. Ridgill, Jr.
*Attorney, Agent, or Firm*—Bachman and LaPointe

[57] ABSTRACT

A thermally improved expanded store front system is disclosed including vertical mullions and horizontal members. The vertical mullions comprise a structural mullion portion which is securely attached to the sill and head members and an exterior mullion half removably secured by anchor means to said structural mullion. The mullions when assembled are adapted to receive clip means which secure the horizontal members in place without the need for screws thereby allowing the members to expand and contract without undue stress. The vertical mullions and horizontal members, which are cut to predetermined lengths may be easily spliced for typical multi-story applications.

6 Claims, 30 Drawing Figures

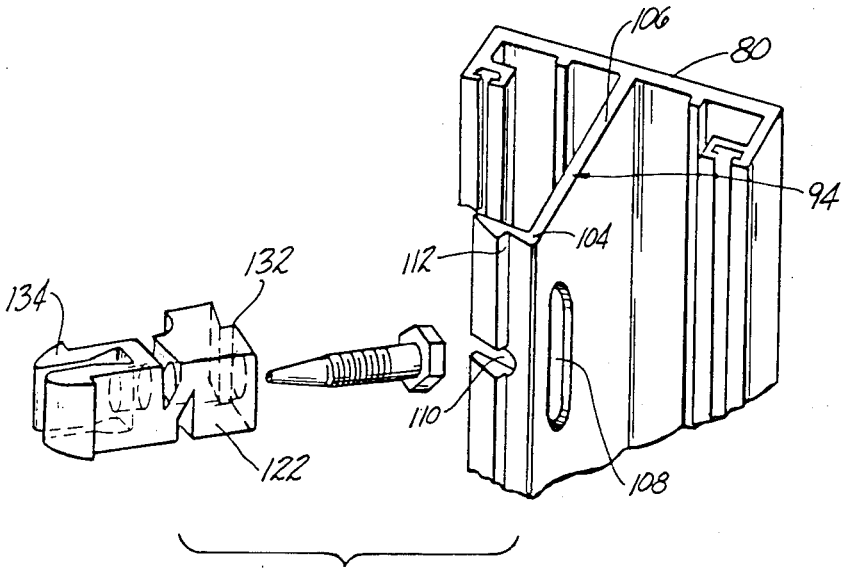
FIG-3
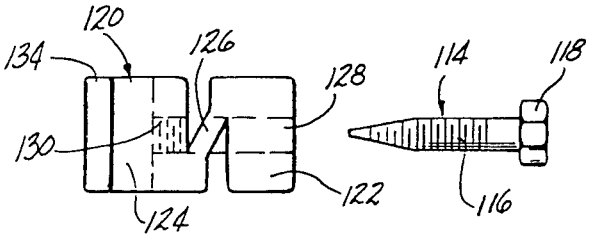
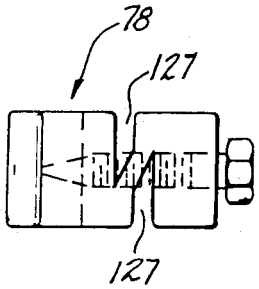
FIG-4C FIG-4B FIG-4A
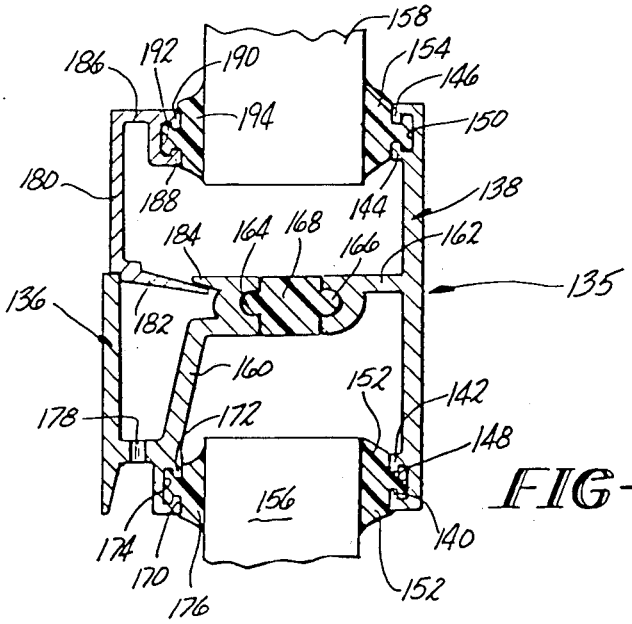
FIG-5

THERMALLY IMPROVED EXPANDED STORE FRONT SYSTEM

This is a Continuation of application Ser. No. 951,921, filed Oct. 16, 1978 now U.S. Pat. No. 4,214,415 issued July 29, 1980.

BACKGROUND OF THE INVENTION

The present invention is directed to improved thermally insulated wall constructions, and in particular, an improved wall construction for expanded store front systems.

In the construction of modern day multi-story buildings, a variety of wall systems or curtain wall structures have been utilized. One such system is known as "stick wall" system and generally is constructed of metal framing members with extruded aluminum members being preferred. The various component parts of a "stick wall" system are factory fabricated with the vertical and horizontal members constructed in predetermined shapes, sizes and lengths and thereafter shipped to the construction site. These members are assembled piece by piece into a grid directly on the building and the grid is then glazed from either the inside or outside of the building depending upon job conditions. Spandrel panels or other types of panels may be installed along with the metal members if desirable.

A typical "stick wall" construction of the type aforenoted is disclosed in U.S. Pat. No. 3,719,014 to Sukolics. The patent discloses a wall construction for mounting panels or the like comprising a vertical support mullion to which there is secured an interior mullion section. The structural portion of the mullion and the interior mullion section interlock through a one way snap lock comprising a nib like portion on the structural portion of the mullion and a channel groove on the interior mullion section. The interior mullion section must be provided with a factory fabricated upper cope having a pair of vertically spaced shoulders and a projection thereon which must be designed specifically to mate with and interlock into the specific horizontal member being used.

The specific design noted above with reference to U.S. Pat. No. 3,719,014 suffers from a number of disadvantages which makes the employment of such a design impractical, energy inefficient and extremely costly. In particular, the design of the vertical mullion is such that the vertical mullion support, which is exposed to exterior environment is in direct contact with the interior mullion section. Thus, the cold member contacts the warm member thus allowing for heat loss through these members as well as forming condensation on these members. Such an arrangement, which allows for heat loss, is highly undesirable in this day of awareness of energy conservation. In addition to the foregoing, a further disadvantage associated with the design of the U.S. Pat. No. 3,719,014 resides in the necessity of making available a plurality of interior mullion sections of different upper cope design in order to accommodate the various horizontal members used depending on whether the construction is to be outside glazed or inside glazed. By requiring a plurality of interior mullion sections, the cost of the construction is increased over that cost which would be incurred if a single mullion section could be used to accommodate both outside glazed and inside glazed horizontal members.

Accordingly, it is a principal object of the present invention to provide a thermally improved expanded store front system wherein a thermal break is provided between the interior and exterior vertical mullion.

It is a particular object of the present invention to provide a thermally improved store front system wherein the vertical mullion section has a single upper cope designed to accommodate various horizontal members.

It is a further object of the present invention to provide an improved store front system which is easily assembled.

It is a still further object of the present invention to provide an expanded store front system which is inexpensive to manufacture.

It is still a further particular object of the present invention to provide an expanded store front system which is architecturally pleasing.

Further objects and advantages of the present invention will be evident from what appears hereinbelow.

SUMMARY OF THE INVENTION

In accordance with the present invention, the foregoing objects and advantages are readily obtained.

The present invention is directed to a thermally improved expanded store front system wherein a thermal break is provided between the vertical mullion support and the exterior mullion section so as to prevent contact between the warm and cold members thereby preventing heat loss. The thermal break takes the form of an anchor which secures the exterior mullion section to the vertical mullion support. In addition, the expanded store front system of the present invention allows for a single mullion section upper cope design which is capable of receiving different horizontal members. The expanded store front system of the present invention is inexpensive to manufacture, easily assembled and energy efficient.

BRIEF DESCRIPTION OF THE DRAWINGS

FIG. 3 is an exploded perspective view of the exterior mullion section and insulating anchor used in accordance with the present invention.

FIGS. 4A, 4B and 4C are perspective views illustrating the insulating anchor and insulating anchor assembly of the present invention.

FIG. 5 is a sectional view of an outside glazed horizontal member taken along line 5—5 of FIG. 1.

DETAILED DESCRIPTION

Figure 1:
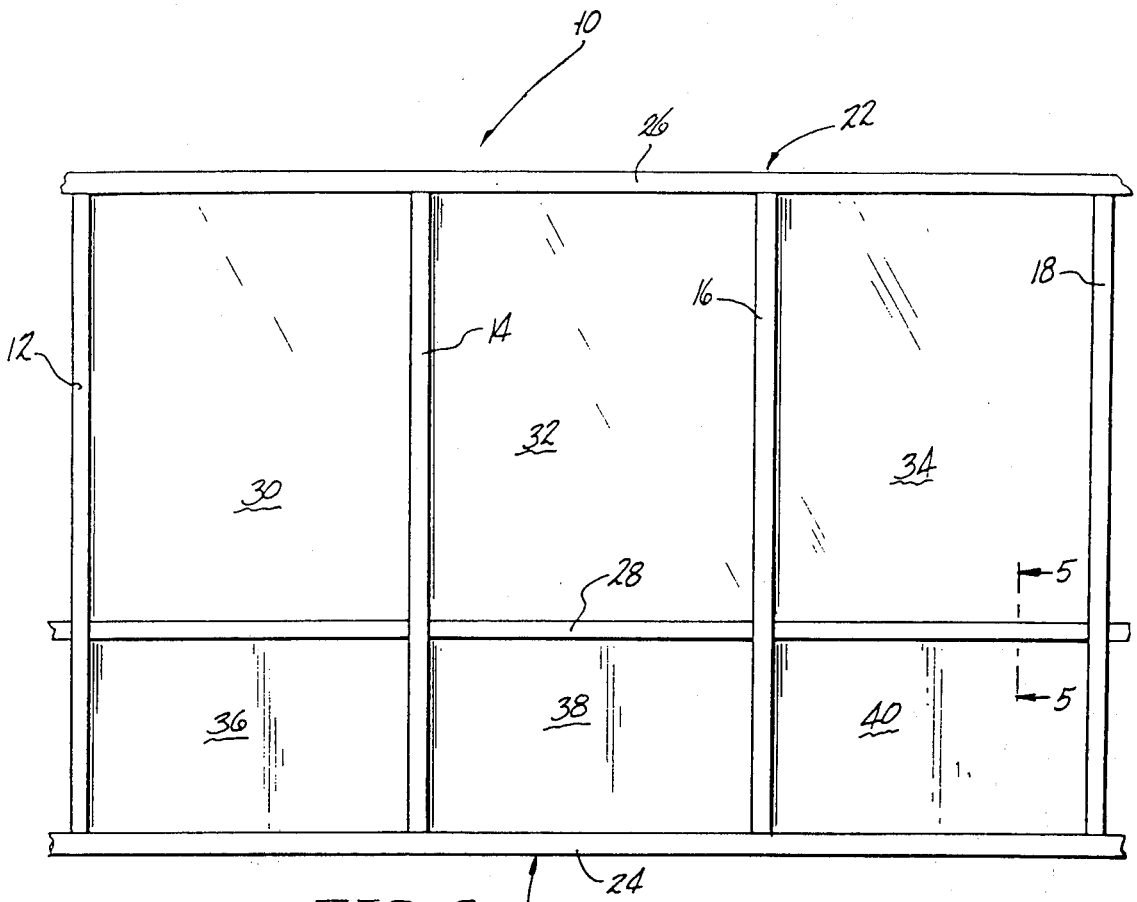
FIG. 1 is an elevational view of an expanded store front system in accordance with the present invention.

Referring to the drawings, and particularly FIG. 1, there is illustrated a one story expanded wall system 10 comprising a plurality of vertical mullions 12, 14, 16 and 18 extending between sill member 20 and head member 22 which are provided with horizontal members 24 and 26, respectively. Additional horizontal member 28 is provided parallel to and intermediate members 24 and 26. Vertical mullions 12, 14, 16 and 18 form with horizontal members 24, 26 and 28 a plurality of openings 30, 32, 34, 36, 38 and 40 which may be outside or inside glazed with insulated glass or insulated panels as desired. It should be appreciated that while the expanded wall system illustrated in FIG. 1 is shown to be one story, the principles of the present invention may be applied to any multi-story system of either outside or inside glaze.

Figure 2:
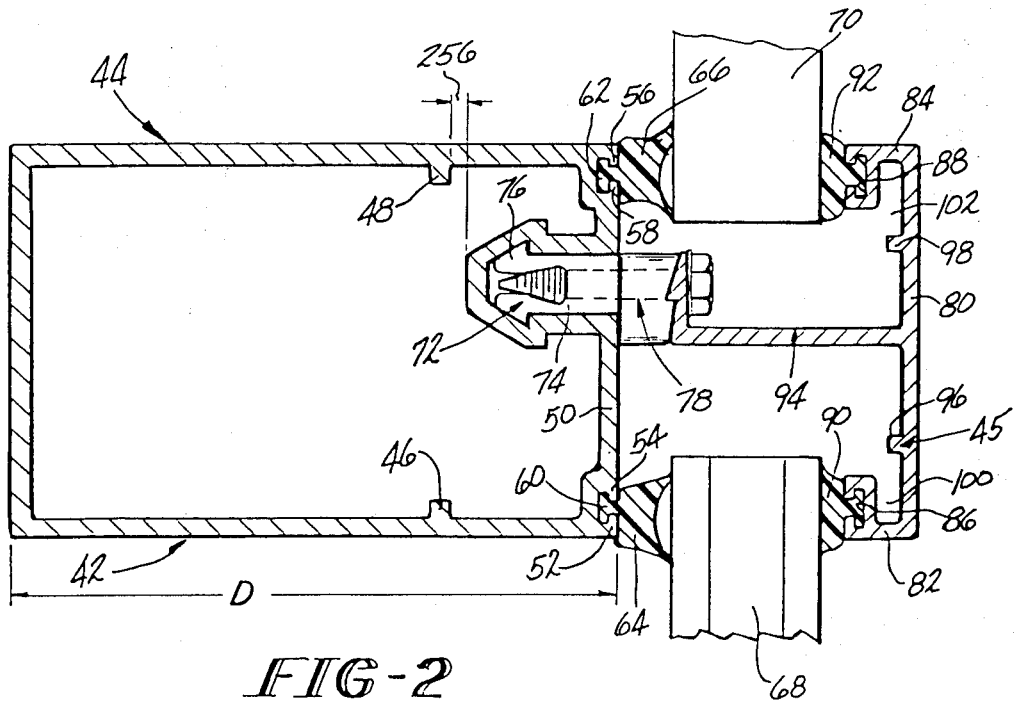
FIG. 2 is a sectional view of the vertical mullion structure of the store front system of the present invention taken along line 2—2 of FIG. 1.

Referring to FIG. 2, there is illustrated the vertical mullion structure 42 of the present invention comprising structural mullion 44 and exterior mullion half 45. In accordance with the present invention, the structural mullion 44 and exterior mullion half 45 are light metal extrusions, preferably aluminum and/or aluminum alloys, which are fabricated at the factory in fixed lengths and shipped to the construction site for assembly. As can be seen in FIG. 2, the structural mullion 44 is illustrated as being generally rectangular in shape however it should be appreciated that the depth D is variable to meet the load conditions of the expanded wall system. Structural mullion 44 is provided on the inside thereof with a pair of continuous opposed nibs 46 and 48, respectively for purposes to be made clear hereinbelow. The portion 50 of the structural mullion 44 facing the exterior of the wall system is provided with two pairs of continuous flanges 52, 54, 56 and 58 defining channels 60 and 62, respectively, adapted to receive appropriate gaskets 64 and 66 which seal against insulated glass 68 and insulated panel 70 when assembled. The mullion 44 is further provided on portion 50 with a continuously extending slot 72 comprising a shaft portion 74 and an arrowhead portion 76 adapted to receive insulating anchor assembly 78, to be discussed in detail hereinbelow, for securing exterior mullion half 45 to structural mullion 44. Exterior mullion half 45 comprises a front sight wall portion 80 and a pair of side wall members 82 and 84 extending substantially perpendicular therefrom toward portion 50 of structural mullion 44. Each of the side wall members 82 and 84, respectively, are provided at their free ends with U-shaped channels 86 and 88, respectively, facing toward wall portion 50 and adapted to receive appropriate gaskets 90 and 92 which seal against insulated glass 68 and insulated panel 70 when assembled. Intermediate side wall members 82 and 84, and substantially parallel thereto is L-shaped extension 94 extending in a direction toward wall portion 50 of structural mullion 44. Intermediate L-shaped extension 94 and each of the side wall members 82 and 84 are continuous flanges 96 and 98, respectively, which form with wall members 82 and 84, U-shaped channels 86 and 88 and front sight wall 80 corresponding slots 100 and 102 for purposes to be expounded on hereinbelow.

As can best be seen with reference to FIG. 3, L-shaped extension 94 is provided with a base portion 104 substantially parallel to front sight wall 80 and a long leg portion 106 extending substantially perpendicular between sight wall 80 and base portion 104. Leg portion 106 is provided with an elongated hole 108 and base portion 104 is provided with cut out 110 adapted to receive thermally insulated anchor assembly 78 in a manner to be expanded on hereinbelow. In addition, base portion 104 is tapered so as to provide an abutment ridge 112 for purposes to be explained. With reference to FIGS. 4A, 4B and 4C, insulating anchor assembly 78 comprises a self tapping screw 114 having a body portion 116 and a head portion 118. Insulating anchor 120 is a single unitary piece adapted to be received over body portion 116 of screw 114 and comprises a first portion 122 and a second portion 124 being connected by connecting portion 126 leaving gaps 127. Portion 122 of insulating anchor 120 is provided with a clearance bore hole 128 in which the screw body 116 freely moves while second portion 124 is provided with a tapped hole 130 adapted to receive screw body 116. The first portion 122 of insulating anchor 120 is provided on its surface facing head portion 118 of screw 114 with an abutment ridge 132 adapted to mate with corresponding abutment ridge 122 on base portion 104 of L-shaped extension 94 as is to be elaborated on hereinbelow. The second portion 124 is provided at its free end thereof with a pair of ribs 134 radiating from the outer surface of portion 124 adapted to be received in arrowhead portion 76 of slot 72 in structural mullion 44.

With reference to FIGS. 2–4, the assembling of the exterior mullion half 45 to structural mullion 44 will be explained. Structural mullion 44 is located and secured in place in a manner to be explained hereinbelow. With particular reference to FIG. 3, insulated anchor assembly 78 is positioned in vertical mullion half 45 such that the body portion 116 between head portion 118 and abutment ridge 132 is inserted within cut out 110 of base portion 104 of L-shaped extension 94 such that abutment ridge 132 on portion 122 mates with the corresponding abutment ridge 112 on base portion 104. To assemble mullion half 45 to structural mullion 44, the pair of ribs 134 are pressed into arrowhead portion 76 of slot 72. The screw 114 is tightened by turning the head 118 with a wrench (not shown) which is positioned on the head by inserting same through the elongated hole 108 in portion 106 of L-shaped extension 94. As the screw 114 is tightened, the anchor 120 is prevented from rotational movement due to the mating of abutment ridges 112 and 132 on the L-shaped member 94 and anchor 120, respectively. As the screw is tightened, gaps 127 are closed and ribs 134 are forced out radially into arrowhead portion 76 thus preventing disengagement of the anchor 120 from slot 72. In addition, as the screw is tightened, mullion half 45 is drawn toward structural mullion 44 so that the surface of the same abuts in sealing fashion against the insulated glass 68 and insulated panel 70.

The insulating anchor assembly 78 offers a number of advantages over means previously used to secure mullion halves to structural mullions, the most important being the elimination of direct contact between the cold and warm members thus eliminating heat loss. In addition to the foregoing, the anchor assembly of the present invention is inexpensive to manufacture and easily assembled.

Referring to FIG. 5, there is shown a cross sectional view of an intermediate horizontal member 135 taken along line 5—5 of FIG. 1. The horizontal member 135 is designed to be an outside glazed type member. Horizontal member 135 comprises an exterior portion or sight wall 136 and interior portion 138. The interior portion 138 of the horizontal member 135 is provided on the side thereof facing exterior portion or sight member 136 with two pairs of continuous flanges 140, 142, 144 and 146 defining channels 148 and 150, respectively, adapted to receive appropriate gaskets 152 and 154 and seal against insulated glass panels 156 and 158, respectively, when assembled. The exterior or sight wall portion 136 is connected to interior portion 138 by a pair of legs 160 and 162 which are integral with portions 136 and 138, respectively. Each of the legs 160 and 162 are provided on their free ends with opposing grooves 164 and 166, respectively, adapted to receive insulator thermal break 168 so as to prohibit contact between the warm and cold members of the horizontal member 135. The thermal break 168 is factory installed and the horizontal member is delivered to the construction site as a one piece unitary structure. Leg 160 is provided with a pair of continuous flanges 170 and 172 which define channel 174 adapted to receive appropriate gasket member 176 which faces in opposition to previously described gasket member 152 and seals insulated glass 156 upon assembly. The leg portion 160 may typically be provided with a plurality of drain slots 178. As noted previously, the horizontal member as shown in FIG. 5 is designed to be an outside glazed horizontal member and is therefore provided with a removable exterior glazing member 180 which is cut to fit between the vertical exterior mullion halves 45 in the manner to be explained in detail hereinbelow. The exterior glazing member 180 is a substantially U-shaped member having a first leg portion 182 adapted to securely fit on exterior portion 136 and extension 184 of leg portion 160 in the manner shown in FIG. 5. The second leg portion 186 of exterior glazing member 180 is provided on the free end thereof with a pair of continuous nibs 188 and 190 which define a channel 192 adapted to receive appropriate seal 194 which seals against insulated glass 158 in opposition to seal 154 in the same manner as previously discussed above with regard to seal 176. It should be appreciated as is the case with the structural mullion 44 and exterior mullion half 45, discussed above, the horizontal members are factory fabricated into extrusions of light metal such as aluminum and aluminum alloys of predetermined lengths and are shipped to the construction site for assembly. While the horizontal member discussed above is designed to be an outside glazed horizontal member, it should be appreciated, as will be discussed hereinbelow, that other horizontal members may be employed in accordance with the present invention.

Figure 6:
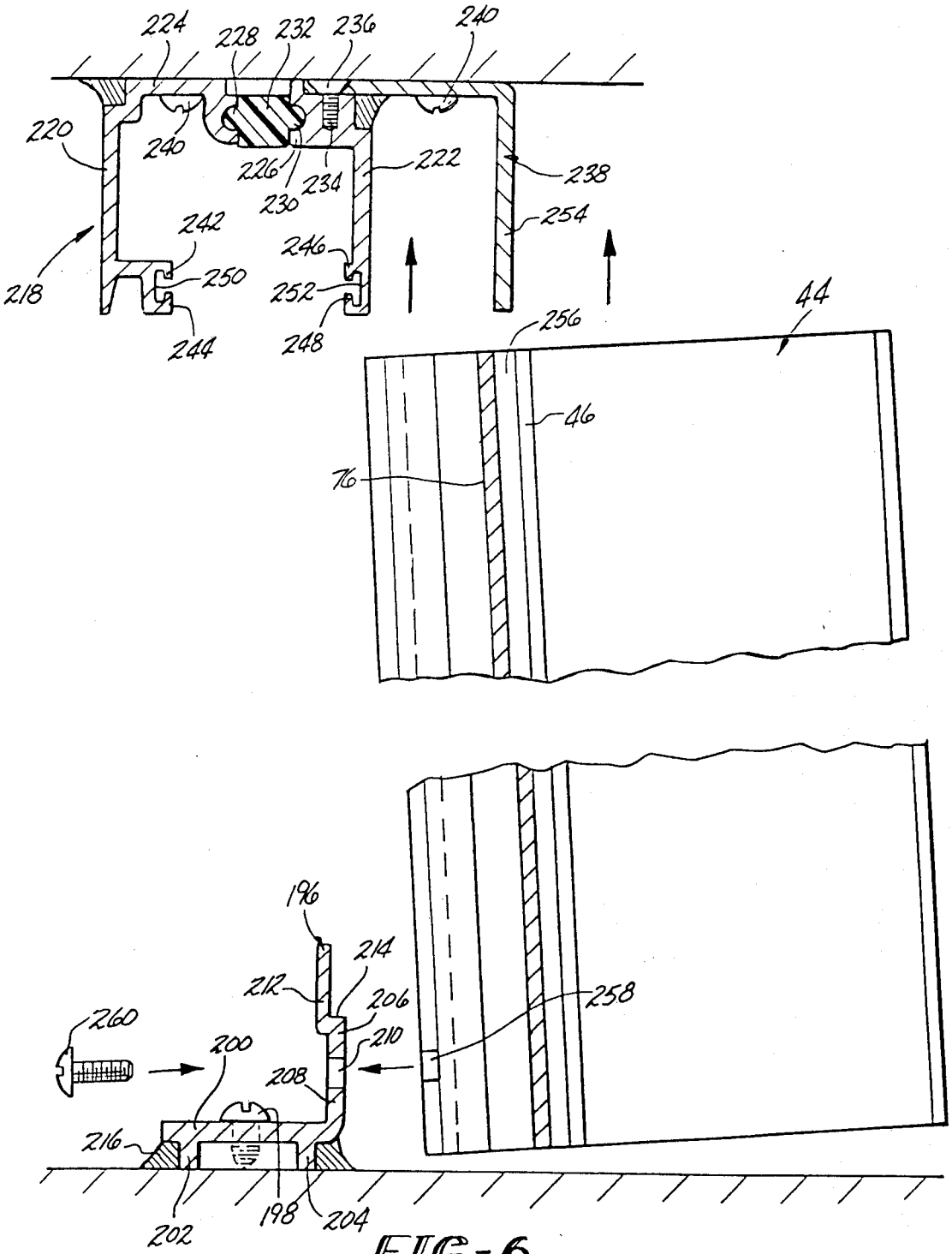
FIG. 6 is a fragmentary cross sectional elevational view illustrating the attachment of the vertical mullion support to the head runner and sill runner.

With reference to FIG. 6, there is shown a fragmentary cross sectional elevational view illustrating the attachment of the structural mullion to the head runner and sill runner in the expanded wall construction of the present invention. Sill runner 196 is positioned in place and secured to the sill by means of fasteners 198. Sill runner 196 is substantially L-shaped in configuration and consists of a base portion 200 having a pair of vertical extensions 202 and 204 which rest on the sill. The leg portion 206 of sill runner 196 comprises a first portion 208 having a hole 210 provided therein and a second portion 212 substantially parallel to the first portion 208 and offset therefrom so as to form a continuous flange 214. Sealant 216 is provided in the grooves between base portions 200 and vertical extensions 202 and 204, respectively. Head runner 218 is a substantially U-shaped member comprising exterior portion 220 and interior portion 222. Each of the portions 220 and 222 are provided with substantially perpendicular base extensions 224 and 226, respectively, which are provided with opposed grooves 228 and 230 adapted to receive a factory installed insulator thermal break 232 in the same manner as previously described with regard to thermal break member 168 in horizontal member 135. Base portion 226 is provided therein with a screw spline 234 adapted to receive self tapping fastener 236 which secures to the head runner 218 L-shaped mullion attachment clip 238 for reasons to be explained hereinbelow. The head runner 218 and mullion attachment clip are secured to the head by means of fasteners 240. Exterior portion 220 and interior portion 222 are provided on their free ends with two pairs of continuous flanges 242, 244, 246 and 248 which define channels 250 and 252, respectively, which are adapted to receive suitable gaskets in the same manner as previously described hereinabove. Mullion attachment clip 238 is provided with a substantially vertically extending portion 254 which is adapted to receive structural mullion 44. Structural mullion 44, as previously described above with reference to FIG. 2, is provided with continuous opposed nibs 46 and 48 which define with the front surface of arrowhead portion 76 a gap 256 which is adapted to receive vertical extension portion 254 of mullion attachment clip 238 as illustrated in FIG. 6. The structural mullion 44 receives extension 254 in the gap 256 wherein said structural million is slidingly positioned to abut the head portion wherein screw spline 258 in the lower end of support mullion 44 mates with hole 210 so as to receive self tapping fastener 260 which secures the structural mullion to the sill runner.

Figure 7A:
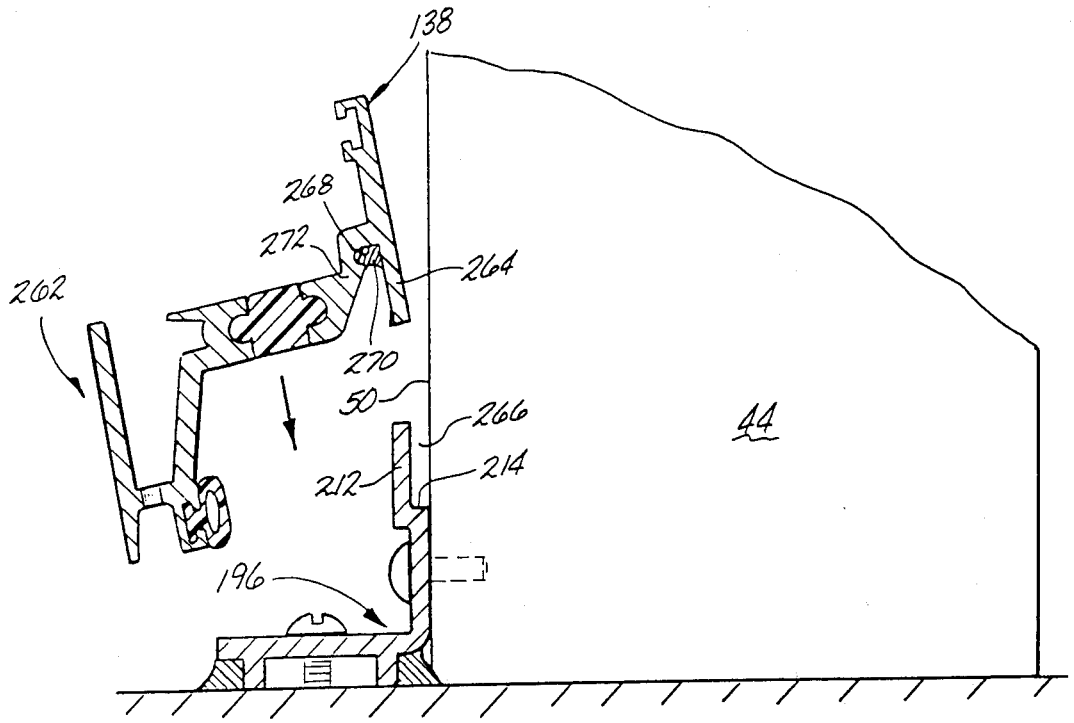
FIGS. 7A and 7B are fragmentary cross sectional elevational views of the sill runner illustrating the installation of an outside glazed horizontal sill member.
Figure 7B:
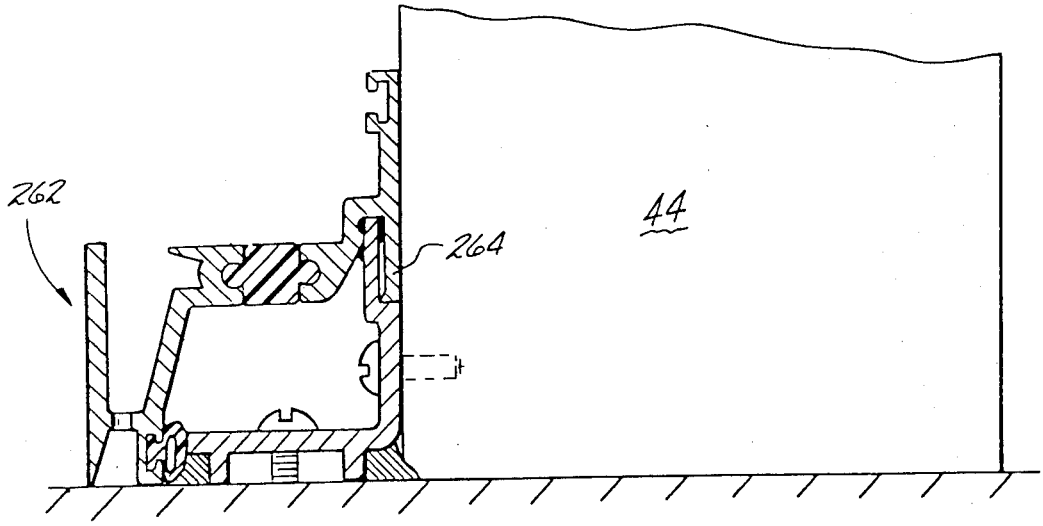

With the structural mullion 44 securely in place as shown in FIG. 7A, horizontal sill member 262, which is an outside glaze designed member, is dropped into place as shown in FIGS. 7A and 7B, respectively. The horizontal sill member 262 is similar to the intermediate horizontal member discussed previously with reference to FIG. 5, the difference being the design of the lower portion of the interior portion of the horizontal sill member. It should be noted that for the sake of consistency, like elements between horizontal sill member 262 and horizontal intermediate member 135 will be designated by the same reference numerals. With reference to FIGS. 7A and 7B horizontal sill member 262 is provided in the interior portion thereof 138 with a short extension portion 264 which is adapted to be received in a channel 266 defined by portion 212 of the sill runner 196, continuous flange 214 and the exterior surface 50 of structural mullion 44. The portion 212 of sill runner 196 is in turn received within channel 268 containing seal member 270, the channel 268 being defined by interior portion 264 and offset leg portion 272, respectively. FIG. 7B illustrates the sill member 262 as installed on the sill runner 196 with structural mullion 44 in place. It should be appreciated that the horizontal sill member is merely dropped in place and requires no fastening means such as screws or the like to be held in place. As a result of this particular structure, the horizontal member is free to expand and contract to a certain degree without creating undue stresses.

Figure 8B:
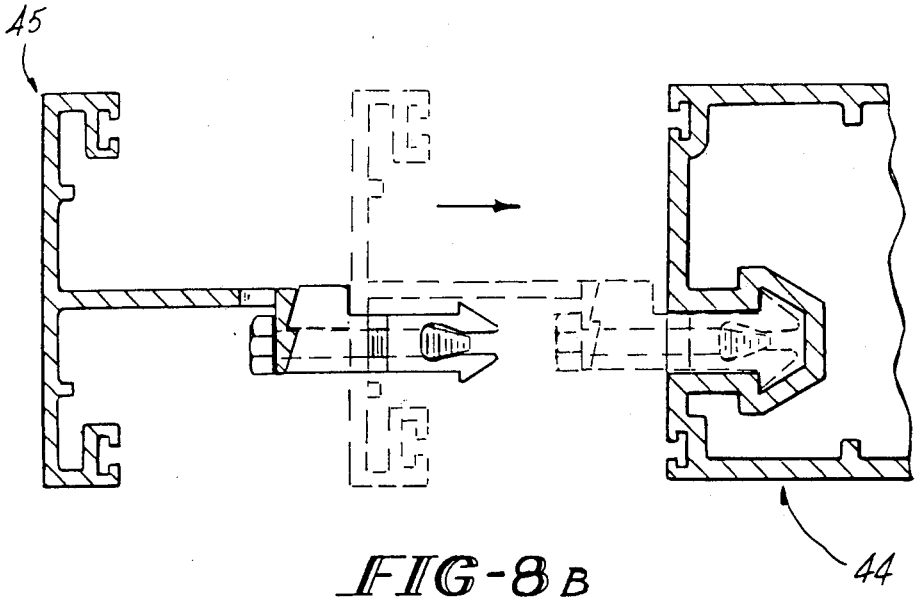
FIGS. 8A and 8B are fragmentary cross sectional views illustrating the installation of the exterior mullion half.
Figure 8A:
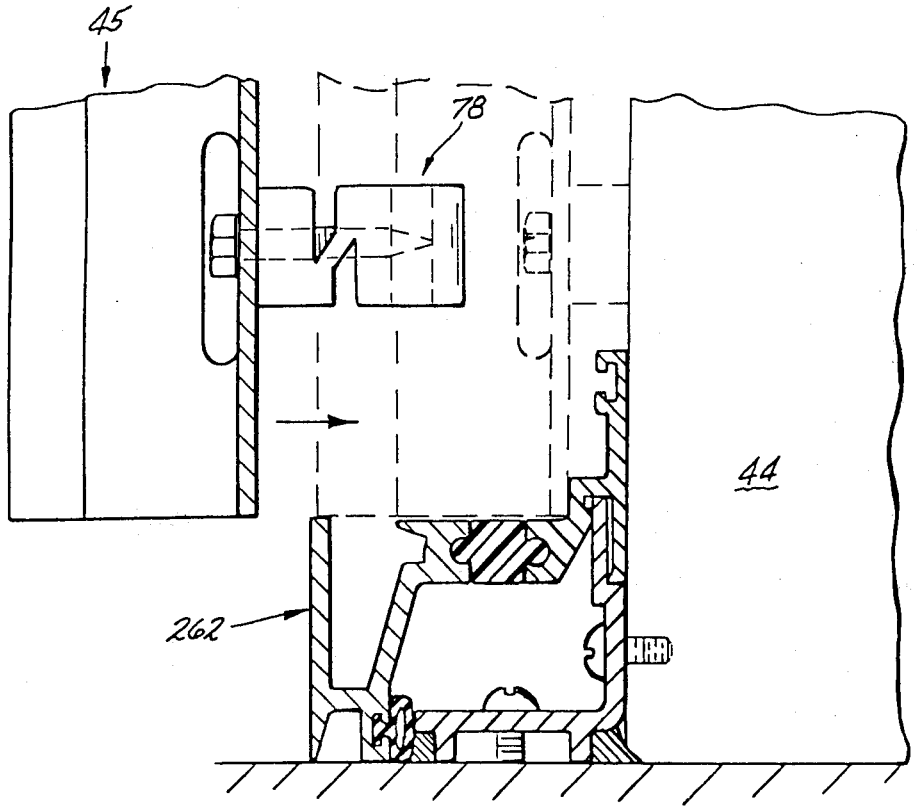

FIGS. 8A and 8B illustrate the installation of the exterior mullion half 45 on the horizontal sill member 262 and structural mullion assembly previously discussed and illustrated with reference to FIG. 7B. With reference to FIGS. 8A and 8B and further reference to FIGS. 2–4 as discussed above, the assembly of the exterior mullion half 45 to the structural mullion 44 is accomplished by an insulated anchor assembly 78. The structural mullion 44 is located in position as previously discussed above with reference to FIG. 6. The insulated anchor assembly 78 is positioned in vertical mullion half 45 in the manner as previously discussed with reference to FIG. 3 such that the body portion 116 between the head portion 118 and the abutment ridge 132 is inserted within cut out 110 of the base portion 104 of L-shaped extension 94 such that abutment ridge 132 on portion 122 mates with the corresponding abutment ridge 112 on the base portion 104. To assemble the mullion half 45 to the structural mullion 44, the mullion half 45 is slid over horizontal sill member 262 and the pair of ribs 134 on the second portion 124 of insulating anchor 120 is pressed into arrowhead portion 76 of the slot 72 of the structural mullion 44. The screw 114 is then tightened by turning the head 118 with a wrench (not shown) which is positioned on the head 118 by inserting same through the elongated hole 108 in portion 106 of the L-shaped extension 94. As noted above with reference to FIGS. 2–4, as the screw 114 is tightened the insulating anchor 120 is prevented from rotational movement by the mating abutment ridges 112 and 132 on the L-shaped member 94 and the anchor 120, respectively. As the screw is tightened, gaps 127 are closed and ribs 134 are radially forced out into arrowhead portion 76 thus preventing disengagement of the anchor 120 from the slot 72. In addition, as the screw is tightened, mullion half 45 is drawn toward structural mullion 44 so that the surface of the same abuts in sealing fashion against the insulated glass 68 and insulated panel 70.

Figure 9B:
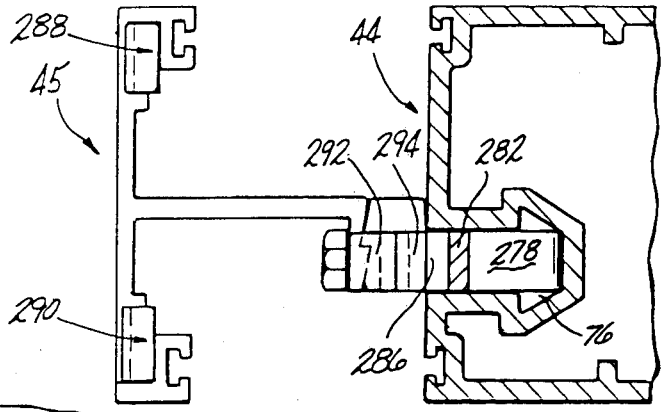
FIGS. 9A and 9B are fragmentary cross sectional views illustrating the installation of clips for securing an outside glazed horizontal member.
Figure 9A:
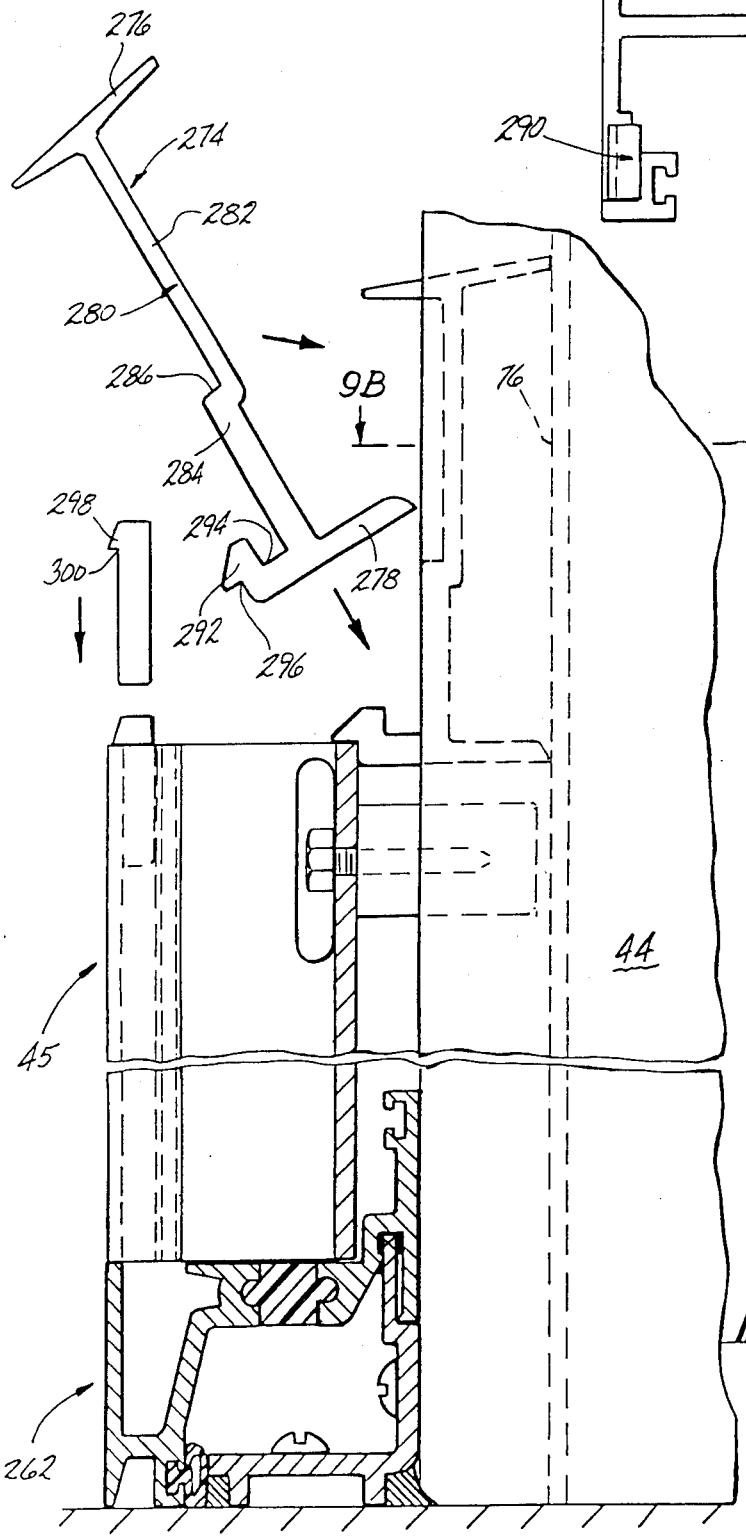

One of the distinct advantages of the expanded wall structure of the present invention resides in the fact that the upper cope design of the vertical mullion 42 is the same whether a horizontal member designed for outside glaze is used, whether a horizontal member designed for inside glaze is used or whether a pressure plate type horizontal member of outside or inside glaze is used. The specific upper cope design of the vertical mullion 42 of the instant invention is such that it is easily adapted to receive any of the aforenoted horizontal member structures. With regard to this specific design, attention is directed to FIGS. 9A and 9B which illustrate the installation of clip members into the upper cope of the structural mullion 44 and the vertical mullion half 45 which are used to secure an outside glazed horizontal member. With reference to FIGS. 9A and 9B, a clip 274 for the horizontal outside glazed member, such as that illustrated with reference to FIG. 5, is inserted into continuously extending slot 72 provided in the structural mullion 44. The clip 274 is generally I-shaped having a top portion 276 and a bottom portion 278 substantially parallel to said top portion 276 with a connecting portion 280 extending therebetween, said connecting portion 280 comprising a first portion 282 and a second parallel offset portion 284 which define a continuous flange 286. Bottom portion 278 is provided on one free end thereof with a nib like structure 292 which defines with second portion 284, a channel 294 and on the other hand defines with bottom portion 278 a crevice 296 which is adapted to rest on the top cope portion of vertical mullion half 45 as illustrated in FIGS. 9A and 9B. It should be appreciated that the clip 274 is designed to be a drop in place item requiring no fastening means such as screws or the like to secure the same to the expanded wall structure of the instant invention. In addition to horizontal clip member 274 there are provided a pair of clips 288 and 290, which again are designed to be drop in items requiring no fastening, adapted to be received in slots 100 and 102 provided in vertical mullion half 45 as defined by flanges 96 and 98, channels 86 and 88 and front sight wall 80 as previously discussed with reference to FIG. 2 above. Each of the clips 288 and 290 are provided with a nib like portion 298 similar to that portion 292 on clip 274 which defines a crevice 300 which lies on the top cope portion of the vertical mullion half 45 in a manner similar to that previously described with regard to clip 274.

Figure 10B:
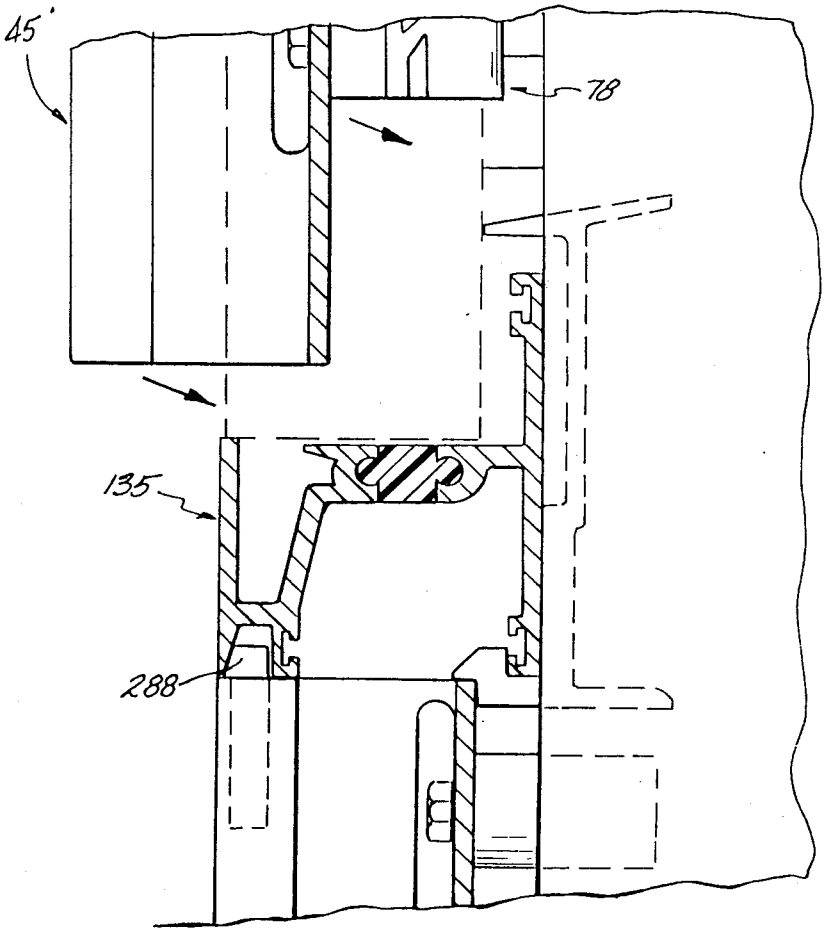
FIGS. 10A and 10B are fragmentary cross sectional views illustrating the installation of an outside glazed horizontal member and an exterior mullion half.
Figure 10A:
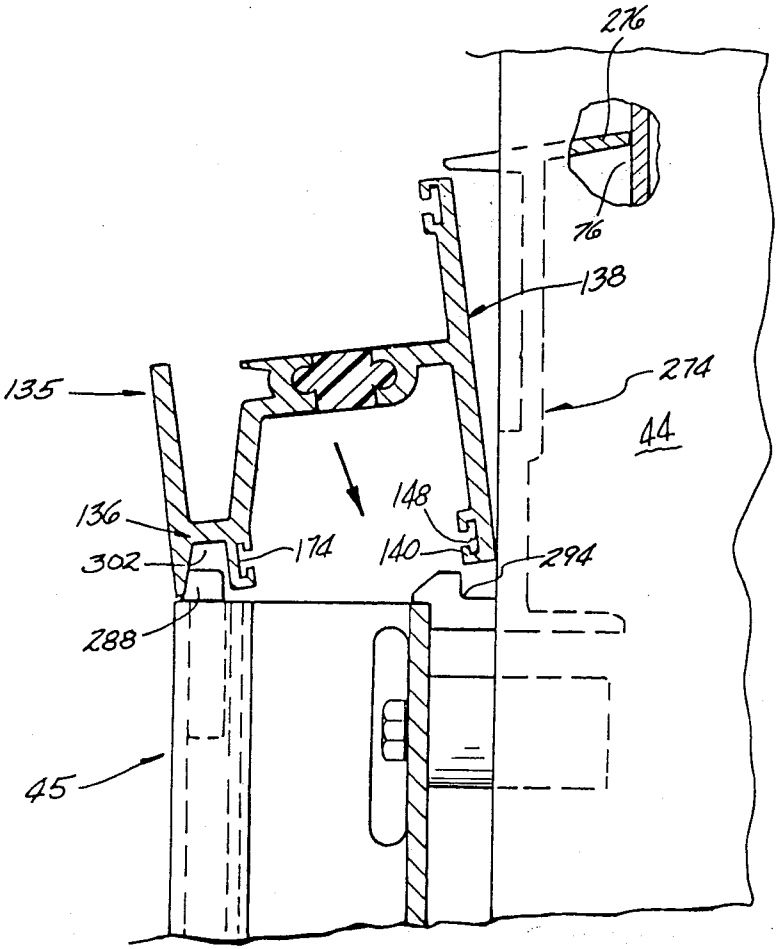

After the installation of the clip means 274, 288 and 290 as noted hereinabove, the intermediate horizontal member as described in FIG. 5 above is ready to be installed into the structure of FIGS. 9A and 9B as further illustrated in FIGS. 10A and 10B. With specific reference to FIGS. 10A and 10B, an outside glazed horizontal member 135, as was previously discussed in detail with reference to FIG. 5, is positioned in place such that interior portion 138 which is provided with continuous flange 140 which forms a part of channel 148 is received in channel 294 of clip member 274 while at the same time a continuous channel 302 defined by channel portion 174, exterior portion 136 and leg 160 of horizontal member 135 is positioned over clips 288 and 290. By such a construction the horizontal member 135 is secured in place while at the same time not requiring fasteners such as screws or the like thereby allowing for a certain amount of expansion or contraction of the horizontal part thereby eliminating the build up of stresses which would otherwise occur if fasteners such as screws or the like were used. FIG. 10B illustrates the outside glazed horizontal member installed wherein a second vertical mullion half 45′ having an anchor assembly 78 is about to be assembled with said support mullion 44 on top of horizontal member 135 in the same manner as described with reference to FIGS. 2–4 and FIGS. 8A and 8B.

Figure 11B:
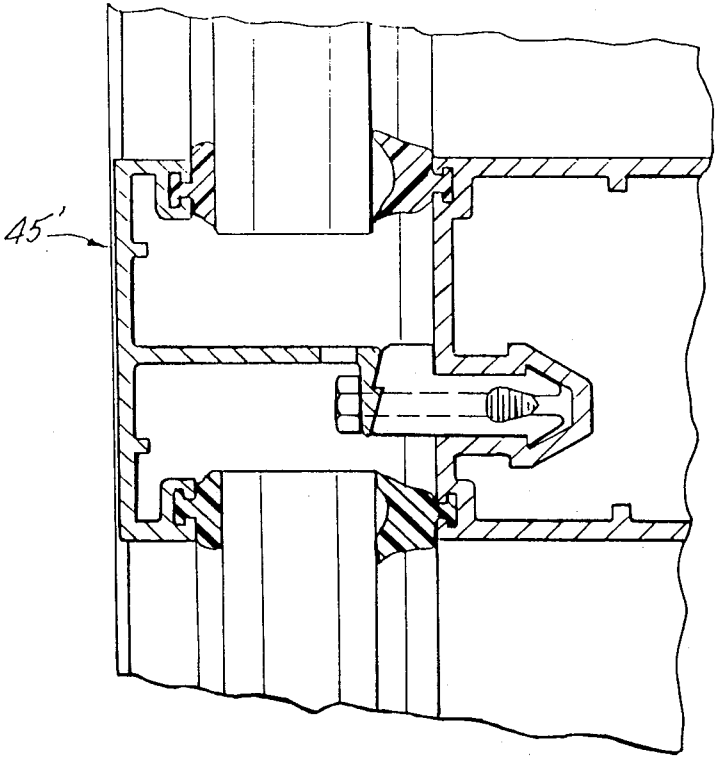
FIGS. 11A and 11B are fragmentary cross sectional views illustrating the expanded store front system of the present invention after typical outside glazing.
Figure 11A:
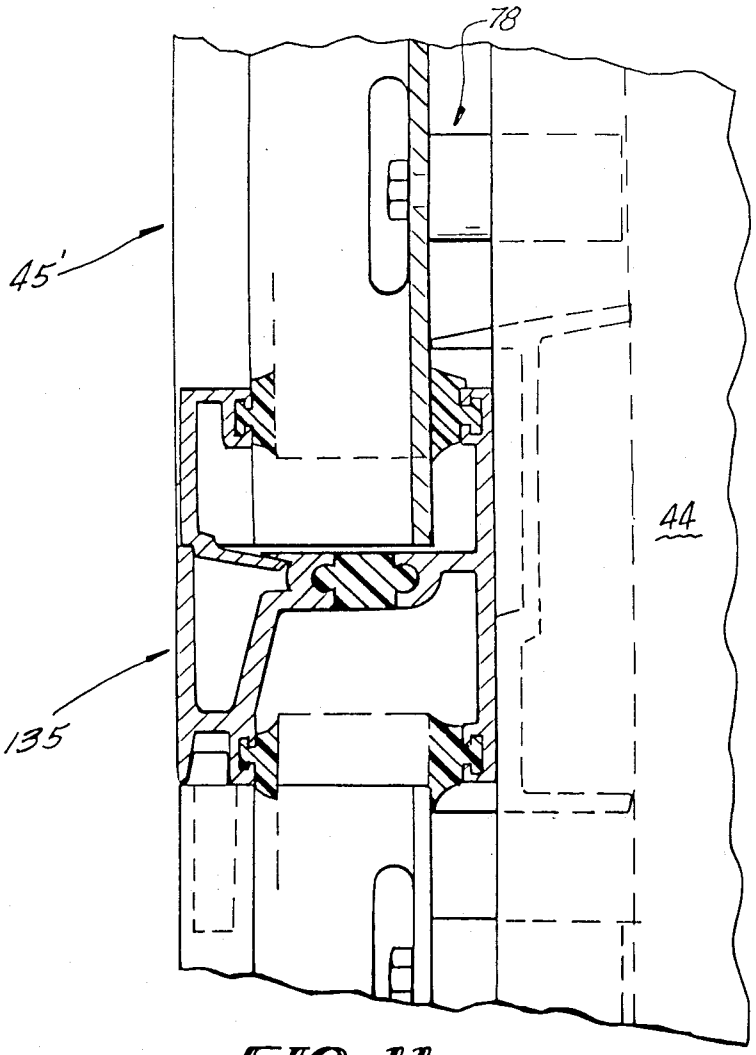

With reference to FIGS. 11A and 11B there is illustrated in fragmentary cross sectional views the details of the expanded wall system of the present invention as assembled with typical details after outside glazing of the structure. As can be seen with reference to FIGS. 11A and 11B and as previously described with reference to FIG. 5 removable exterior glazing member 180 is cut to fit between vertical exterior mullion halves.

Figure 12A:
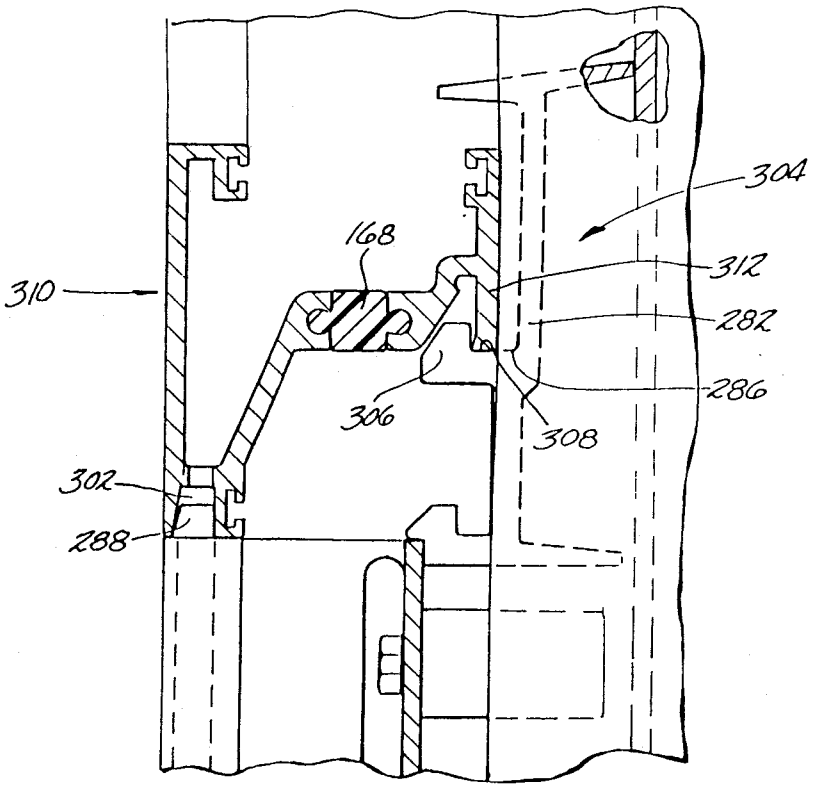
FIGS. 12A and 12B are fragmentary cross sectional views illustrating the installation of clips for securing an inside glazed horizontal member and a pressure plate horizontal member.
Figure 12B:
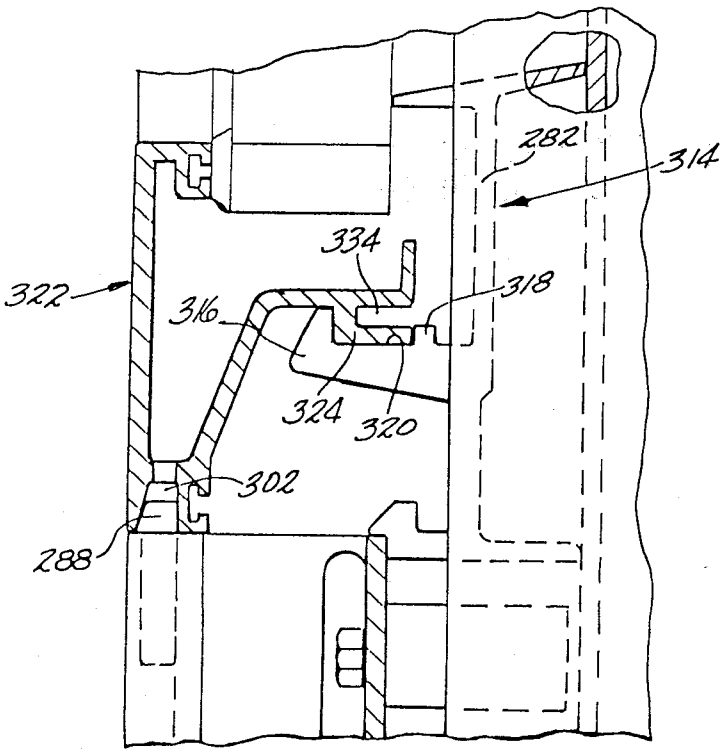

As previously noted above, one of the particular advantages of the design of the present invention is that a single cope design is used and is readily adaptable to receive horizontal members designed for inside glaze, outside glaze or of pressure plate design. To illustrate this point, reference is made to FIGS. 12A and 12B which illustrate cross sectional views of the installation of clips, similar to those views shown in FIGS. 9A and 9B, which may be used for inside glazed horizontal members and pressure plate horizontal members, respectively. With reference to FIG. 12A, clip 304 is similar to clip member 274 and is received within slot 72 of structural mullion 44 and rests on the top cope of vertical mullion half 45 in the same manner as previously discussed with reference to clip 274 as shown in FIGS. 9A to 9B. Clip 304 is provided with a nib like extension 306 which defines with flange 286 and portion 282 a channel 308 which is adapted to receive the particular leg portion 312 of an inside glazed horizontal member 310. The inside glazed horizontal member 310 is similar to that construction of outside glazed member 180 with the exception of a few obvious differences which are easily apparent as herein illustrated. With reference to FIG. 12B there is shown a clip member 314 which is again similar to the clip members 274 and 304 as discussed above. Clip member 314 is provided with a nib like extension 316 having a vertical portion 318 which defines with nib portion 316 a channel 320 adapted to receive pressure plate horizontal member 322 in the form of flange 324. Thus, it is readily seen that the cope of vertical mullion 42 may be easily adapted to receive any horizontal member structure by merely employing a specifically defined clip means which is readily dropped in place in the structural mullion 44 and the vertical mullion half 45. This specific structure offers a number of advantages over the expanded wall designs heretofore known in that it is only necessary to extrude a single vertical mullion structure having a single cope design thereby reducing cost of construction.

Figure 13:
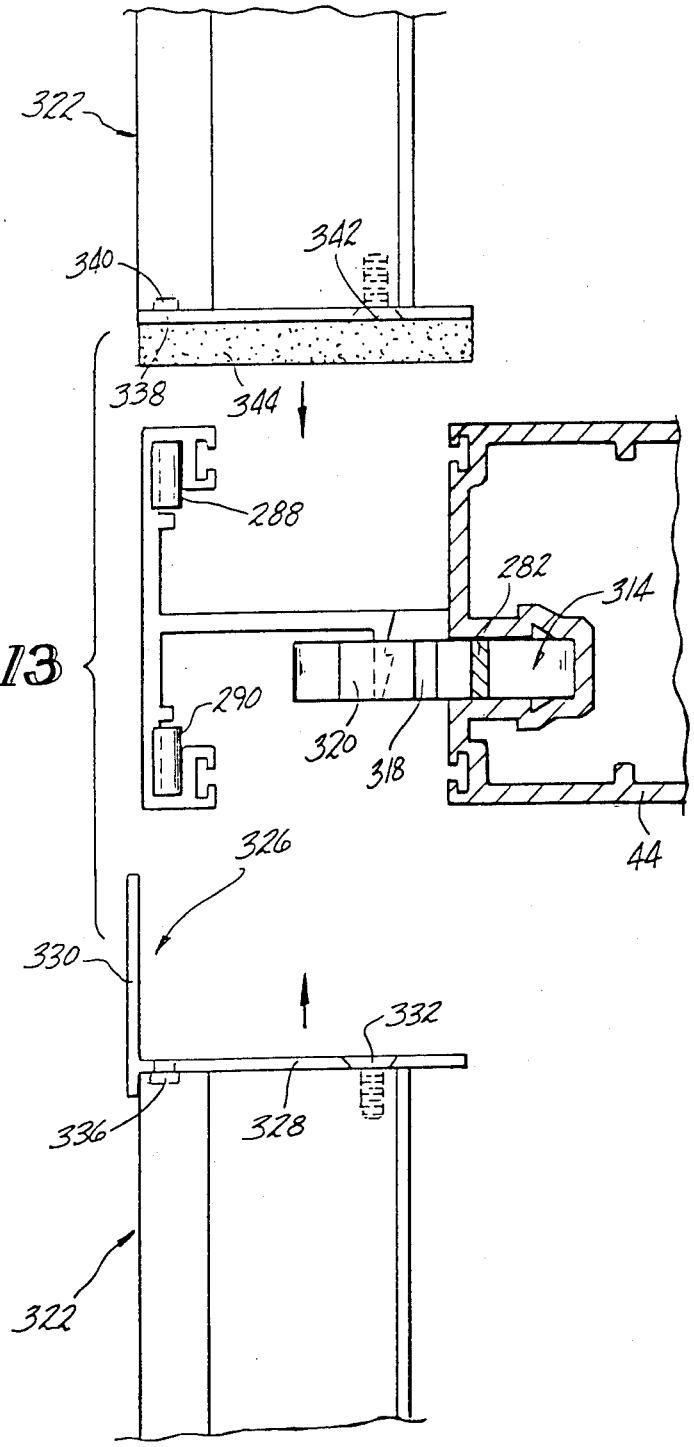
FIG. 13 is an exploded view illustrating a horizontal splice for a pressure plate horizontal member.
Figure 14B:
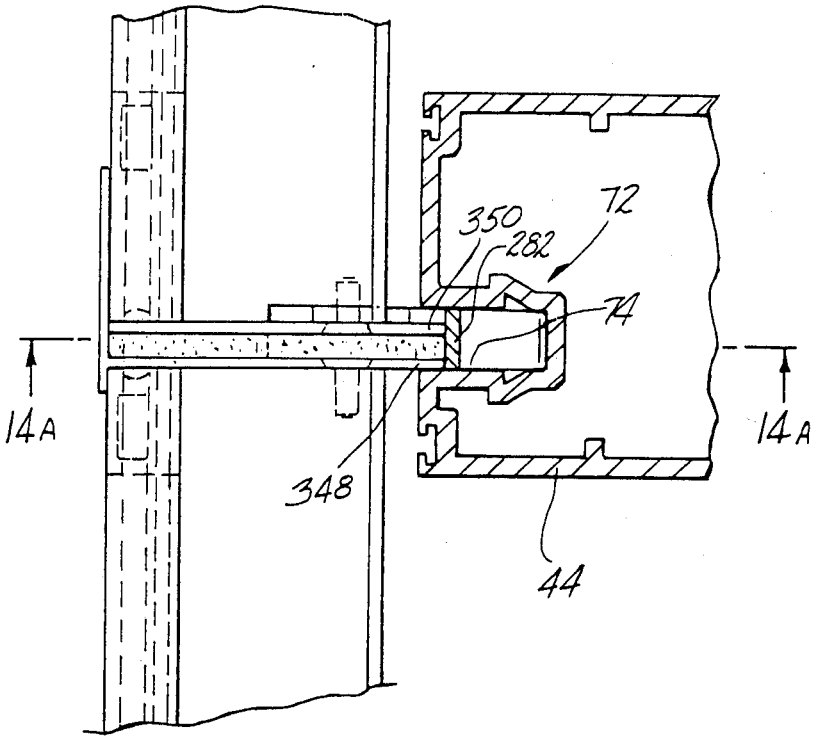
FIGS. 14A and 14B are fragmentary cross sectional views illustrating the assembled splice of FIG. 13.
Figure 14A:
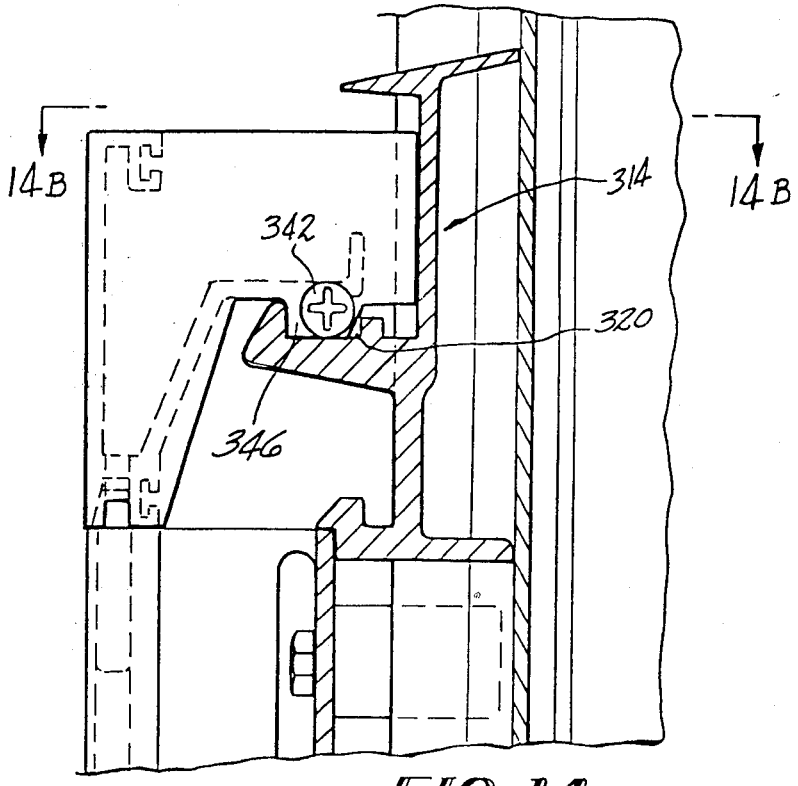

While the foregoing discussion has been general in terms of applying the design for improved expanded well systems to either one story or multi-story applications, it should be appreciated that in order to construct an expanded wall system of wide multi-story design it is necessary to provide an easy and economical means for splicing both the horizontal members and the exterior mullion halves. With reference to the foregoing, FIG. 13 is a perspective exploded view illustrating a horizontal splice used with a pressure plate horizontal member. It should be noted, and reference is made to FIGS. 15A and 15B, that the same shaped splice member can be used on each of the horizontal members previously discussed as long as the appropriate clip 274, 304 or 314 is employed in conjunction therewith as previously described. Returning to FIG. 13, structural mullion 44 is provided with the clip member 314 and vertical mullion half is provided with clip members 288 and 290 as previously described with reference to FIG. 12B. One pressure plate type horizontal member 322 has secured thereto at its free end splice member 326 comprising splice cover 328 and splice cap 330 by means of a fastener 332 which is screwed into a tapped hole (not shown) drilled into gap 334 provided in horizontal member 322 as shown in FIG. 12B. The splice cover 328 is provided with an alignment tab 336 which is received a channel 302 (see FIG. 12B) so as to anchor splice cover 328 while it is being secured in place by fastener 332. The second pressure plate type horizontal member 322 has secured thereto at its free end splice cover 338 which is anchored in place by tab 340 and fastener 342 in the same manner as described above for splice cover 328. Splice cover 338 has secured thereto by adhesive or other suitable means sponge air seal 344. Referring to FIGS. 14A and 14B, the assembled splice joint is illustrated in which a ridge porton 346 of both splice covers 328 and 338, through which fasteners 332 and 342 pass, rest in channel 320 of clip member 314. In addition, both splice covers 328 and 338 are of sufficient length that their edges 348 and 350 are received in shaft portion 74 of continuously extending slot 72 provided in structural mullion 44. Edges 348 and 350 rest against portion 282 of clip 314. As shown in FIG. 14B, this design allows for an expansion and contraction area substantially the width of shaft portion 74 of continuous slot 72 thus avoiding undue stress build up in the structure.

Figure 15B:
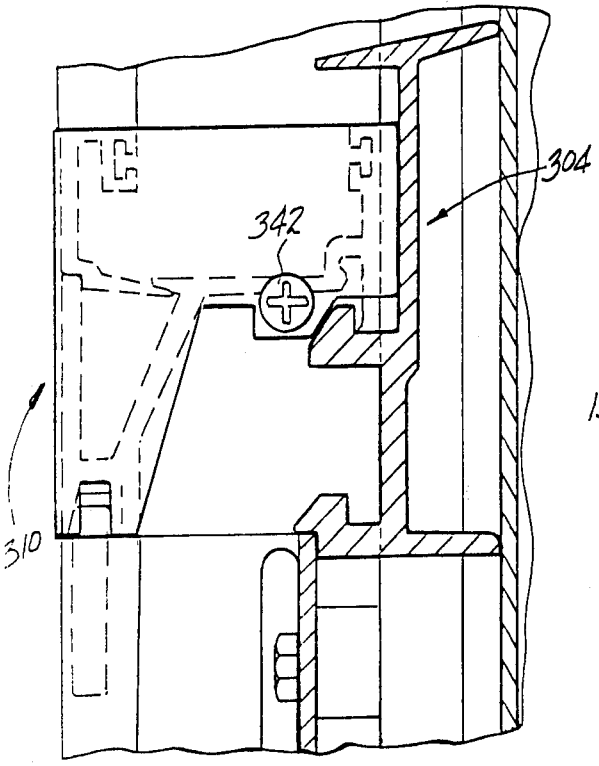
FIGS. 15A and 15B are fragmentary cross sectional views illustrating the splices for various horizontal members.
Figure 15A:
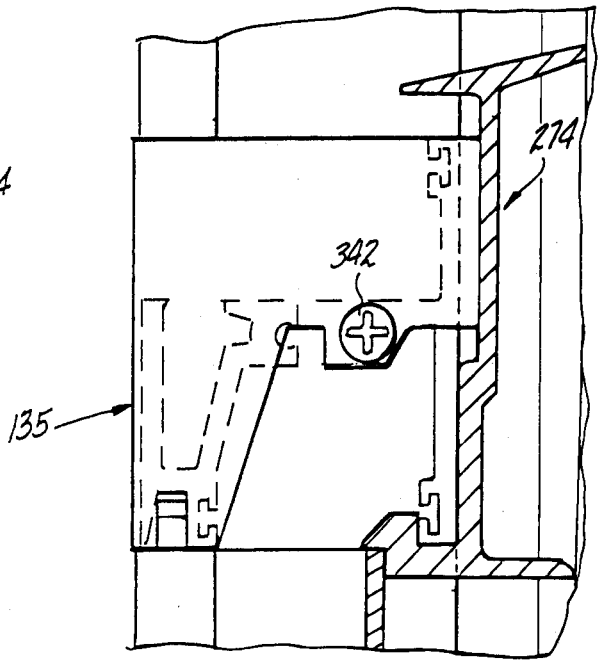

Attention is drawn to FIGS. 15A and 15B which are fragmentary cross sectional views illustrating the splice assembly for the outside glazed and inside glazed horizontal members and their clips as previously described. It should be appreciated that splice member 326 and splice cover 338 are identical to those previously discussed with reference to FIG. 13. The fasteners 332 and 342 are screwed in tapped holes (not shown) which are drilled into the thermal insulator 168 in the area of groove 166. Edges 348 and 350 rest against portion 282 of clips 274 and 304, respectively, and are received in shaft portion 74 of continuous slot 72 in structural mullion 44 in the same manner described with reference to FIGS. 14A and 14B.

Figure 16:
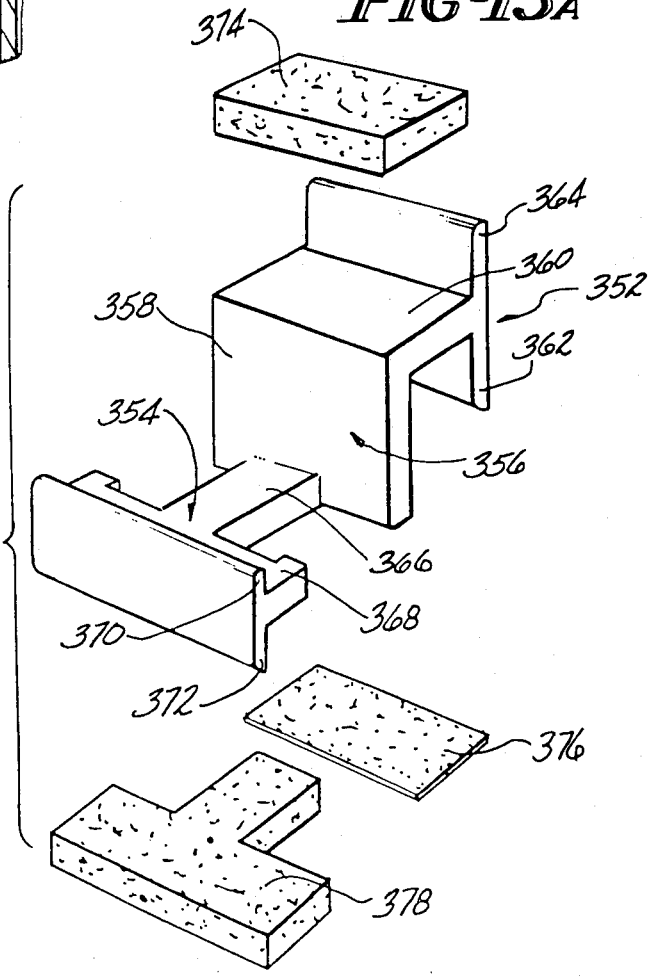
FIG. 16 is an exploded view illustrating the splice for the exterior mullion half.

Referring now to FIG. 16, there is illustrated in an exploded view of the splice joint for the exterior mullion half 45 which is intended to be used in multi-story applications. Splice member 352 is formed of a single unitary piece comprising a substantially T-shaped portion 354 and an L-shaped portion 356. L-shaped portion consists of long leg section 358 and short leg section 360 which is provided at its free end with a pair of perpendicular extending flanges 362 and 364, respectively. The stem portion 366 of T-shaped member 354 extends in a perpendicular direction from the opposite end of long leg portion 358 and in the opposite direction than that of short leg portion 360. Crossing portion 368 extends in a direction substantially parallel to short leg portion 360 and is provided with a pair of perpendicular extending flanges 370 and 372. A relatively thick air seal 374 is provided on the upper portion of leg portion 360 and a further thinner air seal 376 is provided on the lower portion thereof. A further air seal 378 is provided on the lower portion of T-shaped member 354. The seals are pre-installed on the splice member by adhesives or the like.

Figure 17B:
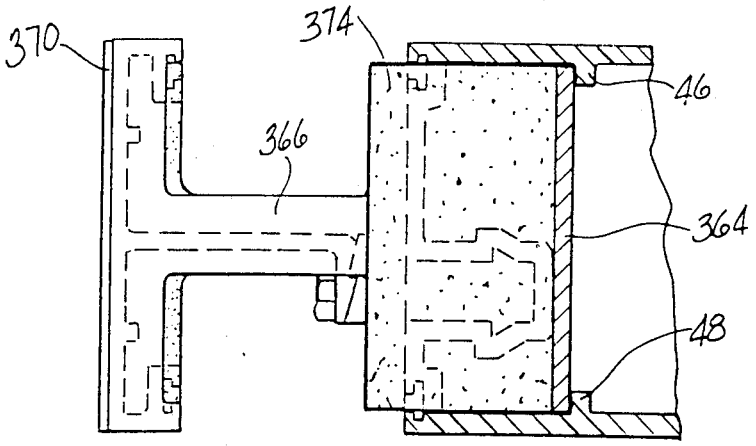
FIGS. 17A amd 17B are fragmentary cross sectional views illustrating the assembled spice of FIG. 16.
Figure 17A:
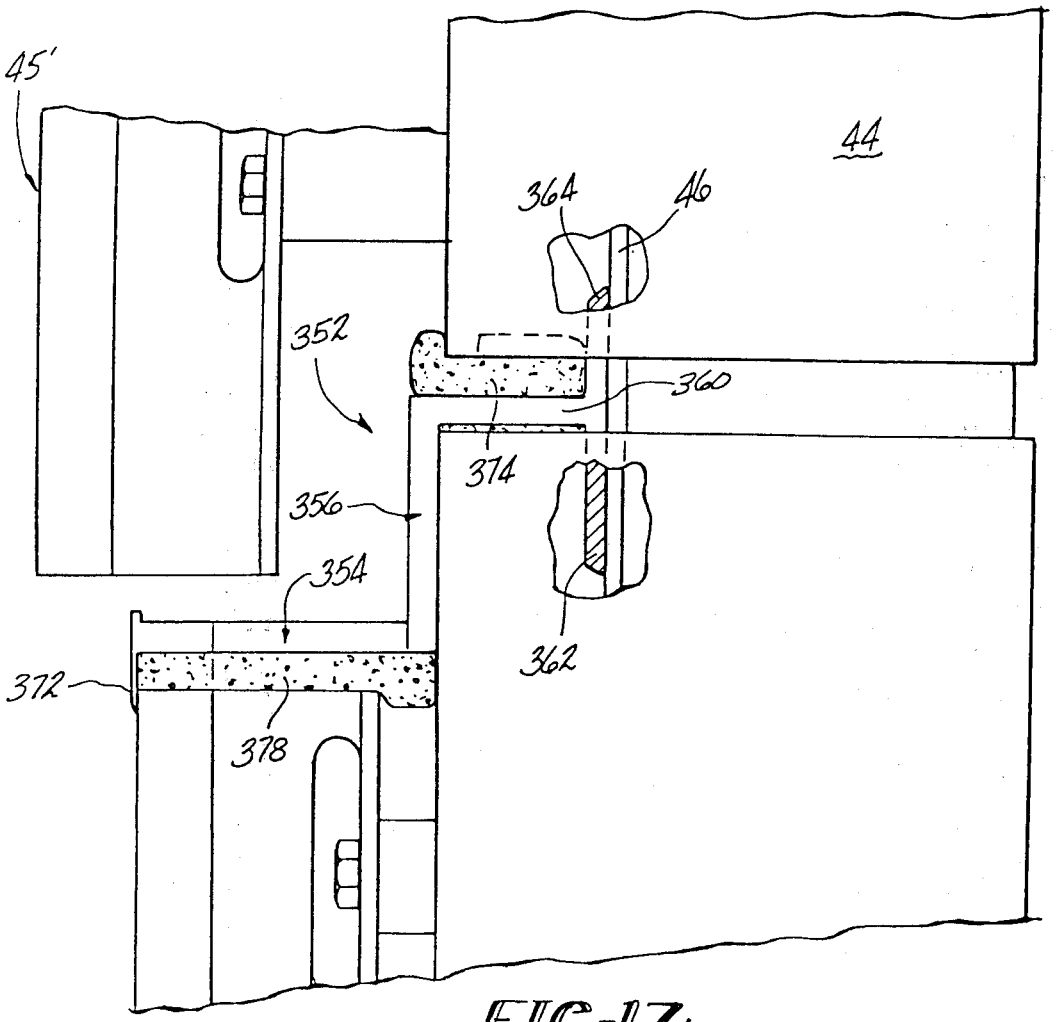

Referring to FIGS. 17A and 17B, the assembly of exterior mullion half splice 352 will be discussed in detail. The splice 352 is positioned on vertical mullion 42 in such a manner that flange 362 on short leg 360 is received in groove 256 formed by nibs 46 and 48 and the outer surface of slot 72 in structural mullion 44. The bottom surface of short leg portion 360 rests on the top of structural mullion 44 while at the same time the bottom portion of T-shaped member 354 rest on the top surface of exterior mullion half 45 with flange 372 extending over the front thereof. A second structural mullion 44' is positioned with respect to the top surface of short leg 360 so that flange 364 is received in groove 256 of the structural mullion 44'. A second exterior mullion half 45' may then be assembled in the same manner as previously discussed.

It should be appreciated that the splice design of the present invention is accomplished without the need of fasteners or the like. In addition, the air seals 374 and 378 act as expansion joints thus reducing stress build up as well as providing erection tolerances.

Figure 18A:
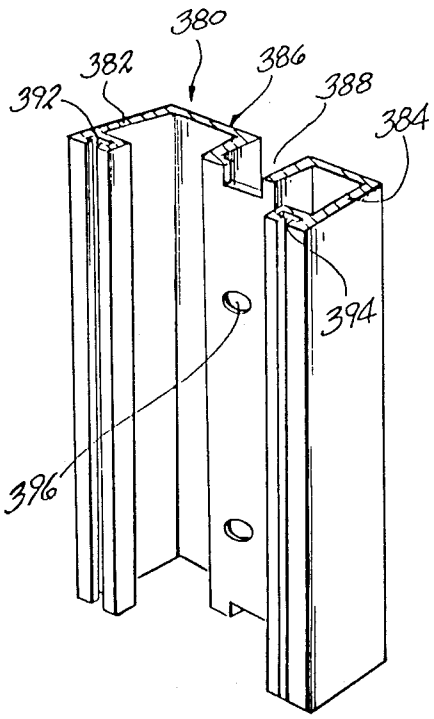
FIGS. 18A and 18B illustrate adaptor means for reducing the glazing pocket from one inch glazing to ¼ inch glazing.
Figure 18B:
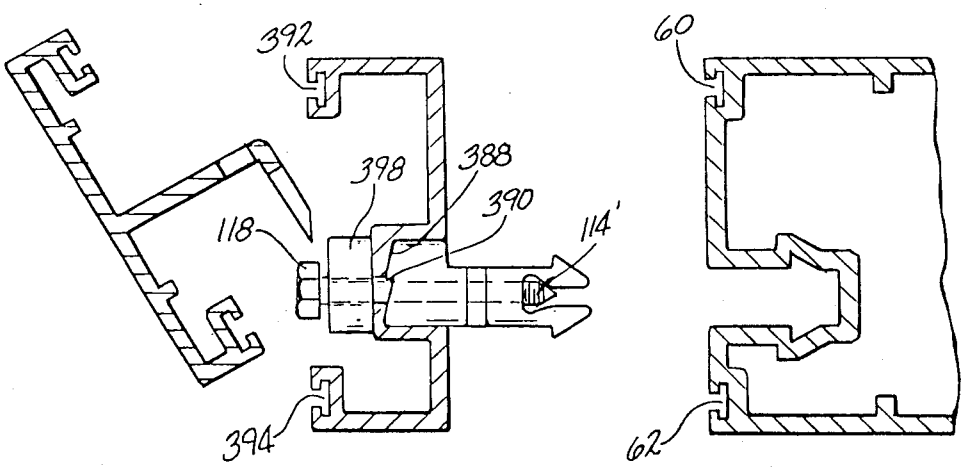

While the expanded store front design of the present invention envisions the use of a one inch glazing infill the system is easily adapted to be used with smaller infills. Such an adaptor and the assembly thereof is illustrated in FIGS. 18A and 18B where the adaptor 380 is a substantially U-shaped aluminum extrusion comprising a first leg portion 382, a second leg portion 384, and a base portion 386. The base portion 386 is provided on its underside with a continuous substantially U-shaped slot 388 having an abutment ridge 390 similar to and for the same purpose as abutment ridge 112 on exterior mullion half 45. The free ends of portions 382 and 384 are provided with channels 392 and 394 for the same purpose as channels 60 and 62 on structural mullion 44. Adaptor 380 is provided with a bore hole 396 for reasons to be made clear hereinbelow. The assembly of the adaptor unit will now be discussed in detail. Self tapping screw 114' which is similar to previously discussed screw 114 but longer is received in thermally insulated spacer 398 which is positioned against the head 118. The screw 114' is then located in hole 396 in adaptor 380 therein after anchor member 120 is secured thereto and the vertical mullion is assembled in the same manner as previously described with reference to FIGS. 2–4.

It should be appreciated that the gaskets and air seals may be made out of any suitable material such as sponge neoprene and the like and that the thermal break material may be any thermoplastic material such as nylon, polypropylene or the like.

The stick wall system according to the present invention is adapted for use on both single and multi-story buildings. Advantageously, all the components are factory fabricated. The lengths of the horizontal and vertical members are limited only by the stock lengths available.

The factory fabricated components are shipped to the job site in lengths or sticks and the sticks are assembled piece by piece into a grid directly on the building. The grid is then glazed from either the inside or the outside depending on the job conditions. The spandrel panels may be installed along with the metal if desirable. It is understood that unlike integral systems, stick systems require installation clearance in the spandrel area, especially if the spandrel panels are installed and sealed from the inside of the building. The present system keeps the clearance in this area to a minimum.

The present system is advantageous over existing wall stick systems in many respects. One advantage is its low cost. Cost savings are effective in both the installation, fabrication, and material costs. The existing stick walls are based on designs that contain 3 and 4 piece members with fasteners and washers. They require power nut drivers and expensive torque wrenches, and infinite patience to install. In accordance with the present invention, a proposed wall has 2 and 3 piece members, practically no fasteners, and nothing at all is required to assemble the majority of the components.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved fastener for securing a first cold metal section to a second warm metal section so as to provide a thermal break therebetween comprising:

a unitary non-metallic insulating portion;

said insulating portion being provided in part with a threaded hole;

a screw portion;

said screw portion comprising a head portion and a threaded stem portion;

said threaded stem portion being received within said threaded hole;

one of said metal sections being provided with means for securing said head portion thereto;

the other of said metal sections being provided with means for receiving said insulating portion such that said one metal section abuts one side of a first part of said insulating portion and said other metal section abuts a second side of said first part of said insulating portion so as to provide a thermal break therebetween when said one metal section is assembled to said other metal section wherein said first part and said second part are adapted to be moved relative to each other along the axis of said screw portion.

2. A fastener according to claim 1 wherein said first part and said second part are connected to each other by means of a flexible connecting portion.

3. A fastener according to claim 1 wherein said second part of said insulating portion is provided with said threaded hole therethrough.

4. A fastener according to claim 3 wherein said first part of said insulating portion is provided with a bore hole therethrough.

5. A fastener according to claim 1 wherein said one side of said first part of said insulating anchor is provided with an abutment ridge adapted to mate with a corresponding abutment ridge on said one metal section so as to prohibit rotational movement of said insulating portion as said screw portion is screwed into said second part of said insulating portion.

6. A fastener according to claim 5 wherein said second part of said insulating portion is substantially arrow shaped and is provided on the free end thereof with a split through which said screw portion extends as said screw portion is screwed into said second part so as to radially extend said arrow shaped portion in said means on said other metal section so as to prevent disengagement of said insulating anchor therefrom.

* * * * *

UNITED STATES PATENT AND TRADEMARK OFFICE

CERTIFICATE OF CORRECTION

PATENT NO. : 4,283,895

DATED : August 18, 1981

INVENTOR(S) : Ronald D. Sukolics

It is certified that error appears in the above-identified patent and that said Letters Patent are hereby corrected as shown below:

Column 12, claim 1, line 12, delete the word "for".

Column 12, claim 1, line 15, after the word "portion" insert --comprising a first part and a second part--.

Column 12, claim 1, line 27, change "a" to read --said--.

Signed and Sealed this

*Twentieth* Day of *October 1981*

[SEAL]

*Attest:*

GERALD J. MOSSINGHOFF

*Attesting Officer*

*Commissioner of Patents and Trademarks*